US008262316B2

(12) United States Patent
Slater et al.

(10) Patent No.: US 8,262,316 B2
(45) Date of Patent: Sep. 11, 2012

(54) SURFACE GRAVITY WAVE GENERATOR AND WAVE POOL

(75) Inventors: Kelly Slater, Los Angeles, CA (US); Adam Fincham, Los Angeles, CA (US)

(73) Assignee: Kelly Slater Wave Company, LLC, Los Angeles, CA (US)

( * ) Notice: Subject to any disclaimer, the term of this patent is extended or adjusted under 35 U.S.C. 154(b) by 409 days.

(21) Appl. No.: 12/274,321

(22) Filed: Nov. 19, 2008

(65) Prior Publication Data

US 2010/0124459 A1 May 20, 2010

(51) Int. Cl.
*E02B 3/00* (2006.01)
*A47K 3/10* (2006.01)
*A63H 23/16* (2006.01)

(52) U.S. Cl. ..... 405/79; 4/491; 472/128

(58) Field of Classification Search ..... 405/79; 4/491; 472/128

See application file for complete search history.

(56) References Cited

U.S. PATENT DOCUMENTS 2,994,201 A * 8/1961 Hutchings ..... 405/27
3,008,673 A * 11/1961 Caddell ..... 244/130
3,530,211 A * 9/1970 Uhlig et al. ..... 264/136
3,802,697 A * 4/1974 Le Mehaute ..... 4/491
3,913,332 A * 10/1975 Forsman ..... 405/79
4,078,605 A * 3/1978 Jones ..... 166/359
4,792,260 A * 12/1988 Sauerbier ..... 405/79
4,812,077 A * 3/1989 Raike ..... 405/79
6,336,771 B1 1/2002 Hill et al.
2003/0198515 A1 10/2003 McFarland et al.
2005/0178310 A1 * 8/2005 Loui et al. ..... 114/271
2009/0260146 A1 * 10/2009 Webber ..... 4/491

FOREIGN PATENT DOCUMENTS

WO WO 00/05464 2/2000
WO WO 2006/060866 6/2006

OTHER PUBLICATIONS

International Search Report and Written Opinion dated Feb. 19, 2010, issued by the International Searching Authority in connection with counterpart international application No. PCT/US2009/065212.
Rayleigh Lord, On Waves., Phil. Mag., 1(1876), p. 257-279.
Boussinesq M.J., "Théorie de l'intumescence liquide, appelée onde solitaire ou de translation, se propageant dans un canal rectangulaire," C.-R. Acad. Sci. Paris, 72(1871).
Certified English translation of: Boussinesq M.J., "Theorie de l'intumescence liquide, appelée onde solitaire ou de translation, se propageant dans un canal rectangulaire," C.-R. Acad. Sci. Paris, 72(1871), p. 755-59.)

* cited by examiner

*Primary Examiner* — Tara Mayo-Pinnock
(74) *Attorney, Agent, or Firm* — Mintz Levin Cohn Ferris Glovsky and Popeo, P.C.

(57) ABSTRACT

A surface gravity wave generator and wave pool is disclosed. A wave pool is formed of opposing side walls and a center channel of water. The channel includes a bottom contour with a depth that runs from a deep end to a shoal or beach. One or more three-dimensional foils are vertically arranged along at least one side wall, and moved against the water in the channel. Each foil has a curvilinear cross-sectional geometry that defines a leading surface that is adapted to generate a wave in water moving past the leading surface, and a trailing surface configured for flow recovery to avoid separation of the flow of water in the wave and to mitigate drag from the foil from the water moving past the leading surface.

14 Claims, 7 Drawing Sheets

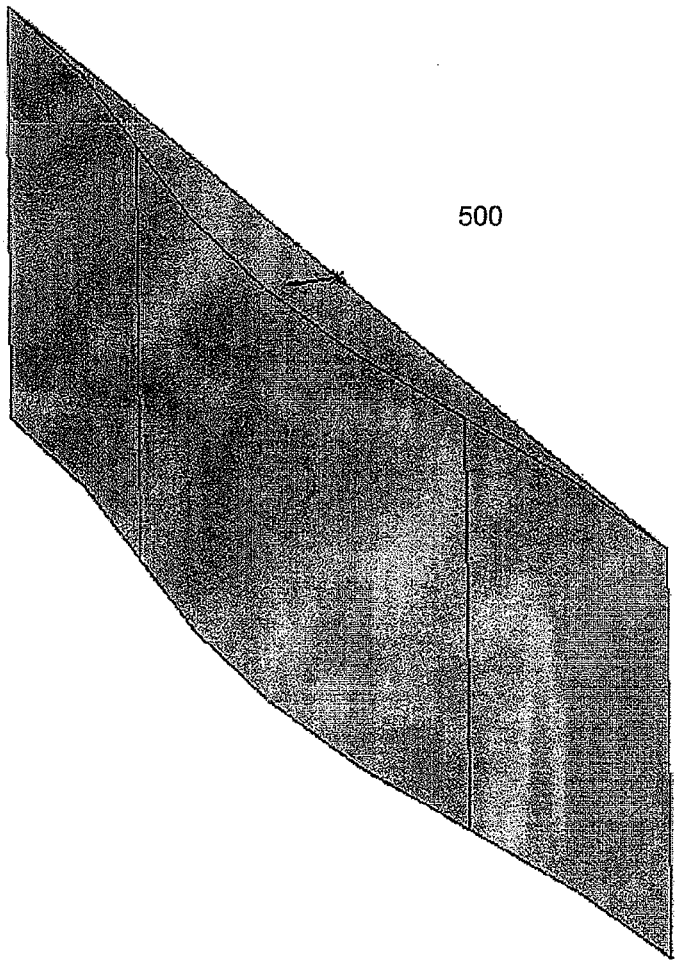
FIG. 7A
FIG. 7B
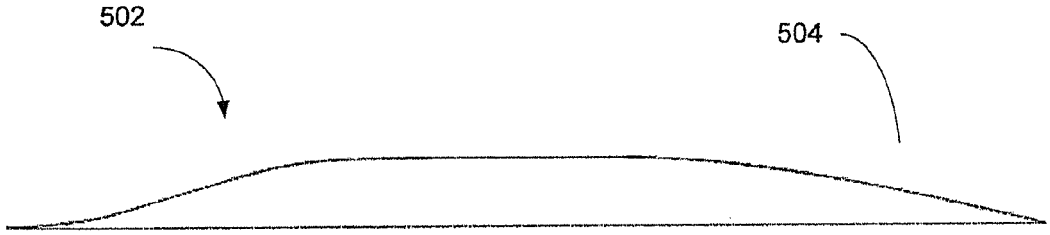

SURFACE GRAVITY WAVE GENERATOR AND WAVE POOL

BACKGROUND

Ocean waves have been used recreationally for hundreds of years. One of the most popular sports at any beach with well-formed, breaking waves is surfing. Surfing and other board sports have become so popular, in fact, that the water near any surf break that is suitable for surfing is usually crowded and overburdened with surfers, such that each surfer has to compete for each wave and exposure to activity is limited. Further, the majority of the planet's population does not have suitable access to ocean waves in order to even enjoy surfing or other ocean wave sports.

Another problem is that the waves at any spot are varied and inconsistent, with occasional "sets" of nicely formed waves that are sought after to be ridden, interspersed with less desirable and, in some cases, unrideable waves. Even when a surfer manages to be able to ride a selected wave, the duration of the ride lasts only a mere 2-30 seconds on average, with most rides being between 5 and 10 seconds long.

Ocean surface waves are waves that propagate along the interface between water and air, the restoring force is provided by gravity, and so they are often referred to as surface gravity waves. FIG. 1 illustrates the principles that govern surface gravity waves entering shallow water. Waves in deep water generally have a constant wave length. As the wave interacts with the bottom, it starts to "shoal." Typically, this occurs when the depth gets shallower than half of the wave's length, the wave length shortens and the wave amplitude increases. As the wave amplitude increases, the wave may become unstable as the crest of the wave is moving faster than the trough. When the amplitude is approximately 80% of the water depth the wave starts to "break" and we get surf. This run up and breaking process is dependent on the slope angle and contour of the beach, the angle at which the waves approach the beach, the water depth and properties of the deep water waves approaching the beach. Refraction and focusing of these waves is possible through changes to the bottom topography.

Ocean waves generally have five stages: generation; propagation, shoaling, breaking, and decay. The shoaling and breaking stages are the most desirable for rideable waves. The point of breaking being strongly dependent on the ratio of the water depth to the waves amplitude also depends on the contour, depth and shape of the bottom surface, and the velocity, wavelength and height of the wave, among other factors. In general a wave can be characterized to result in one of four principal breaker types: spilling, plunging, collapsing; and surging. Of these wave types the spilling waves are preferred by beginner surfers while the plunging waves are revered by more experienced surfers. These breaker types are illustrated in FIG. 2.

Various systems and techniques have been tried to replicate ocean waves in a man-made environment. Some of these systems include directing a fast moving, relatively shallow sheet of water against a solid sculpted waveform to produce a water effect that is ridable but is not actually a wave. Other systems use linearly-actuated paddles, hydraulics or pneumatics caissons or simply large controlled injections of water to generate actual waves. However, all of these systems are inefficient in transferring energy to the "wave", and none of these systems, for various reasons and shortcomings, have yet to come close to generating a wave that replicates the desired size, form, speed and break of the most desirable waves that are sought to be ridden, i.e. waves entering shallow water that plunge, breaking with a tube and which have a relatively long duration and sufficient face for the surfer to maneuver.

SUMMARY

This document presents a wave generator and wave pool that generates surface gravity waves that can be ridden by a user on a surfboard.

In one aspect, a wave generator for a pool of water defined by a channel having a side wall is disclosed. The wave generator includes one or more foils. Each foil is arranged vertically along at least a major part of the side wall and adapted for movement in a direction along a length of the side wall. Each foil has a curvilinear cross-sectional geometry that defines a leading surface that is adapted to generate a wave in the water from the movement, and a trailing surface configured for flow recovery to avoid separation of the flow of water in the wave and mitigate drag from the foil from the movement. The wave generator further includes a moving mechanism connected between the side wall and the one or more foils for moving the one or more foils in the direction along the length of the side wall to generate a surface gravity wave by each of the one or more foils.

In another aspect, a wave pool is disclosed. The wave pool includes a channel containing water and having a side wall having a height, and a bottom contour that slopes upward away from the side wall toward a shoal or beach. The wave pool further includes one or more foils, as substantially described above. In some implementations, the wave pool includes two or more foils, and preferably at least four foils.

In yet another aspect, a wave generator for generating a surface gravity wave is disclosed. The wave generator includes a three-dimensional foil having a curvilinear cross-sectional geometry that defines a leading surface that is adapted to generate a wave in water moving past the leading surface, and a trailing surface configured for flow recovery to avoid separation of the flow of water in the wave and to mitigate drag from the foil from the water moving past the leading surface.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

FIGS. 7A and 7B are a perspective view and cross-sectional view, respectively, to illustrate a shape of a foil for a linear section of wall.

Like reference symbols in the various drawings indicate like elements.

DETAILED DESCRIPTION

Figure 1:
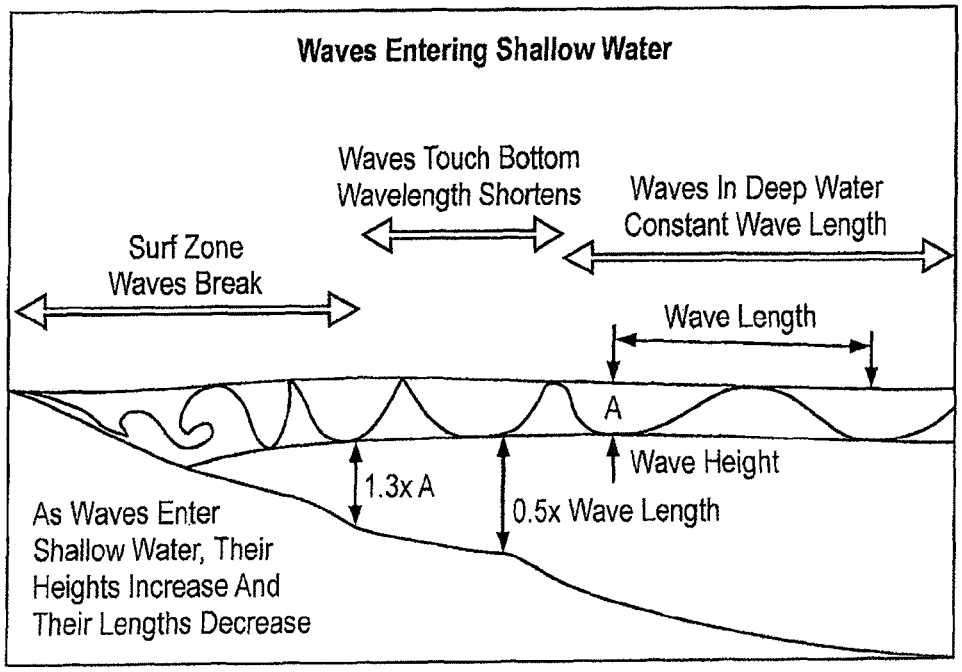
FIG. 1 depicts properties of waves entering shallow water.
Figure 2:
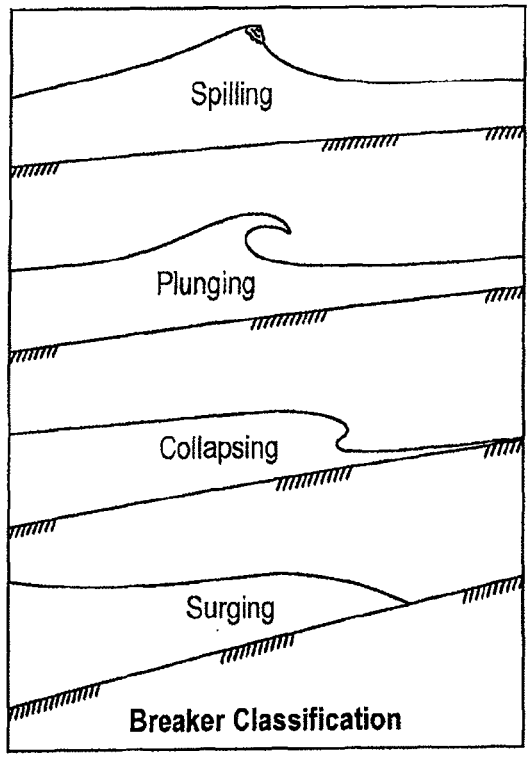
FIG. 2 illustrates four general types of breaking waves.

This document describes an apparatus, method, and system to generate waves of a desired surfability. Surfability depends on wave angle, wave speed, wave slope (i.e. steepness), breaker type, bottom slope and depth, curvature, refraction and focusing. Much detail is devoted to solitary waves as they have characteristics that make them particularly advantageous for generation by the apparatus, method and system presented here. As used herein, the term "solitary wave" is used to describe a shallow water wave, or "surface gravity wave" having a single displacement of water above a mean water level. A solitary wave propagates without dispersion. It very closely resembles the type of wave that produces favorable surf in the ocean. A theoretically-perfect solitary wave arises from a balanced between dispersion and nonlinearity, such that the wave is able to travel long distances while preserving its shape and form, without obstruction by counteracting waves. A wave form of a solitary wave is a function of distance x and time t, and can be characterized by the following equation:

$$\eta(x, t) = A\operatorname{sech}_0^2\left(\sqrt{\frac{3A}{4h_0^3}}\left(x - t\sqrt{g(h_0 + A)}\right)\right)$$

where A is the maximum amplitude, or height, of the wave above the water surface, $h_0$ is the depth of the water, g is the acceleration of gravity and $\eta(x,t)$ is the height of the water above $h_0$. The length of a solitary wave, while theoretically infinite, is limited by water surface elevation, and can be defined as:

$$L = \frac{2\pi}{k} \text{ where } k = \sqrt{\frac{3A}{4h_0^3}}$$

Pools

The systems, apparatuses and methods described herein use a pool of water in which solitary type or other surface gravity waves are generated. In some preferred implementations, the pool is circular or annular, being defined by an outer wall or edge that has a diameter of 200 to 800 feet or more. Alternatively, a round or circular pool having a diameter of less than 200 feet can be used, however, a diameter of 450 to 500 feet is preferred. In one exemplary implementation, the pool is annular with a center circular island that defines a channel or trough. In this annular configuration, the pool has an outer diameter of 500 feet and a channel width of at least 50 feet, although the channel can have a width of 100 feet or more, which can yield 30-70 feet of rideable wave length.

In another exemplary implementation, the pool may be a contiguous basin such as a circular pool without a center island. In the circular configuration, the pool can have a bottom that slopes up toward the center to a shoal or sill, and may include a deeper trough or lead to a shallow spill or flat surface. In yet other implementations, the pool can be any closed-loop, curvilinear channel, such as a racetrack shape (i.e. truncated circle), oval, or other rounded shape. In still other implementations, the pool can include an open or closed looped linear or curvilinear channel through which water is flowed, and which may or may not use a water recapture or recirculation and flow mechanism.

Figure 3A:
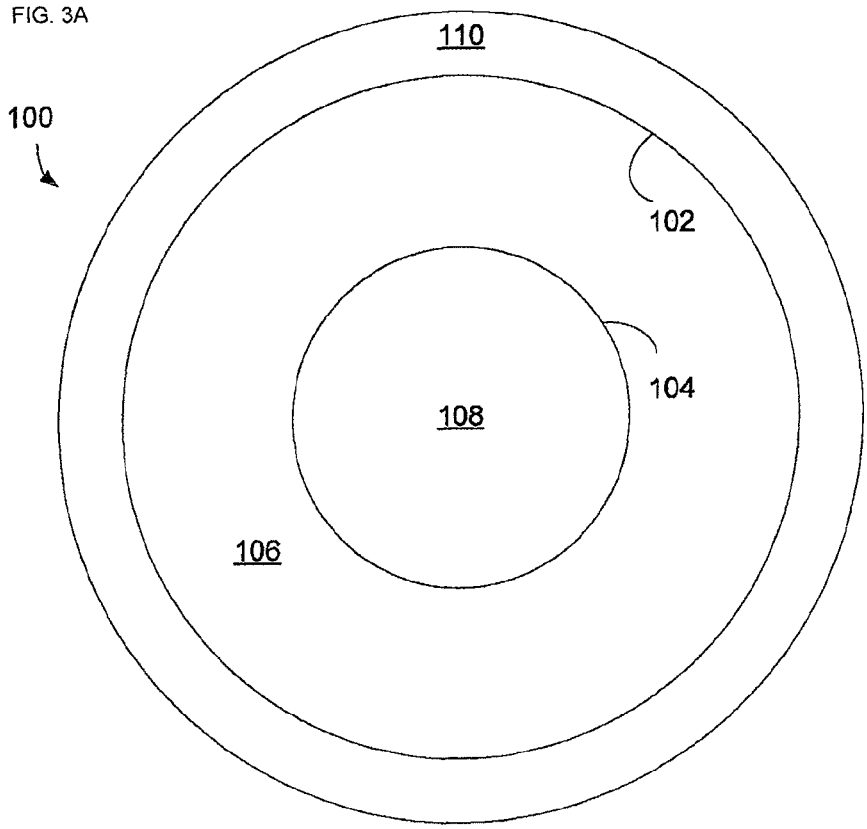
FIGS. 3A and 3B are a top and side view, respectively, of a pool having an annular shape.
Figure 3B:
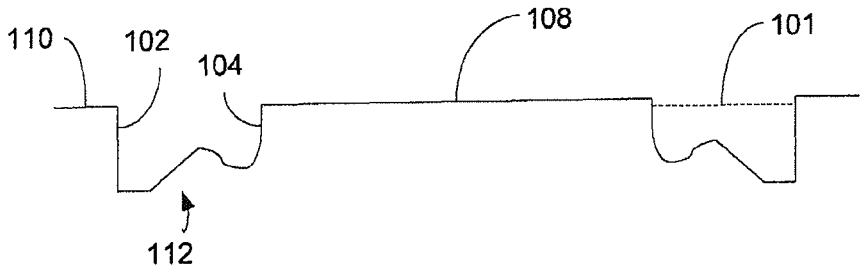

FIGS. 3A and 3B are top and cross-sectional views, respectively, of a pool 100 in accordance with an annular implementation. Pool 100 has a substantially annular shape that is defined by an outer wall 102, an inner wall 104, and a water channel 106 between and defined by the outer wall 102 and the inner wall 104. In annular implementations, the outer wall 102 and inner wall 104 may be circular. The inner wall 104 can be a wall that extends above a mean water level 101 of the water channel 106, and can form an island 108 or other type of platform above the mean water level 101. Alternatively, the inner wall 104 may form a submersed reef or barrier between the water channel 106 and a second pool. For example, the second pool can be shallow to receive wash waves resulting from waves generated in the water channel 106. Pool 100 further includes side 110. In some implementations, the side 110 can include a track such as a monorail or other rail for receiving a motorized vehicle, and the vehicle can be attached to at least one wave generator, preferably in the form of a movable foil as described further below. In other implementations, outer wall 102, with or without cooperation with side 110, can host a wave generator in the form of a flexible wall or rotating wall with built-in foils, also as described further below.

Wave Generator

Figure 4:
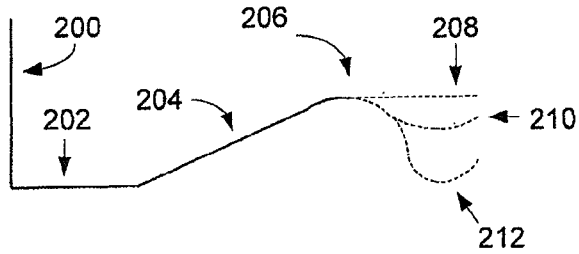
FIG. 4 illustrates a bottom contour of a pool.

FIG. 4 illustrates a bottom contour of a pool, whether the pool is linear, curvilinear, circular, or annular, for a critically-sloped beach design. The bottom contour includes a side wall 200. The side wall 200 can be an inner side wall or an outer side wall. The side wall 200 has a height that at least extends higher than a mean water level, and preferably extends above a maximum amplitude, or height, of a generated wave. The side wall 200 is adapted to accommodate a wave generator, such as a foil that is vertically placed on the side wall 200 and moved along the side wall 200 laterally. The bottom contour further includes a deep region 202, which in some configurations extends at least long enough to accommodate the thickness of the foil. The deep region 202 can extend further than the thickness of the foil. The intersection of the side wall 200 and the deep region may also include a slope, step or other geometrical feature, or a track/rail mechanism that participates in guiding or powering the motion of the foil. A swell can be produced to have an amplitude up to the same or even greater than the depth of the deep region 202, however, most surface gravity waves theoretically become unstable at amplitudes of 80% the water's depth.

The bottom contour of the pool further includes a slope 204 that rises upward from the deep region 202. The slope 204 can range in angle from 1 to 16 degrees, and preferably from 5 to 10 degrees. The slope 204 can be linear or curved, and may include indentions, undulations, or other geometrical features. The bottom contour further includes a shoal 206 or sill. The surface from a point on the slope 204 and the shoal 206 provides the primary break zone for a generated wave. Wave setup in the break zone can change the mean water level. The shoal 206 can be flattened or curved, and can transition into a flattened shallow planar region 208, a shallow trench 210, or a deep trench 212, or any alternating combination thereof. The shoal 206 can also be an extension of the slope 204 to terminate directly into a beach. The beach may be real or artificial. The beach may incorporate water evacuation systems that in one implementation would take the form of grates through which the water passes down into, these may be linked to the general water recirculation and/or filtering systems. The beach may also incorporate wave damping baffles that help to minimize the reflection of the waves and reduce along shore transport and currents.

The bottom contour is preferably formed of a rigid material, and can be overlaid by a synthetic coating. In some implementations, the bottom may contain sections of softer more flexible materials, for example a foam reef may be introduced that would be more forgiving during wipeouts. The coating can be thicker at the shoal 206 or within the break zone. The coating can be formed of a layer that is less rigid than the rigid material, and may even be shock dampening. The slope 204, shoal 206 and/or other regions of the bottom contour can be formed by one or more removable inserts. Further, any part of the bottom contour may be dynamically reconfigurable and adjustable, to change the general shape and geometry of the bottom contour on-the-fly, either through motorized mechanics or inflatable bladders, or other similar dynamic shaping mechanisms. For instance, removable inserts or modules can be connected with a solid floor. The inserts or modules can be uniform about the circle, or variable for creating recurring reefs defined by undulations in the slope 204 or shoal 206. In this way particular shaped modules can be introduced at specific locations to create a section with a desirable surf break.

Figure 5:
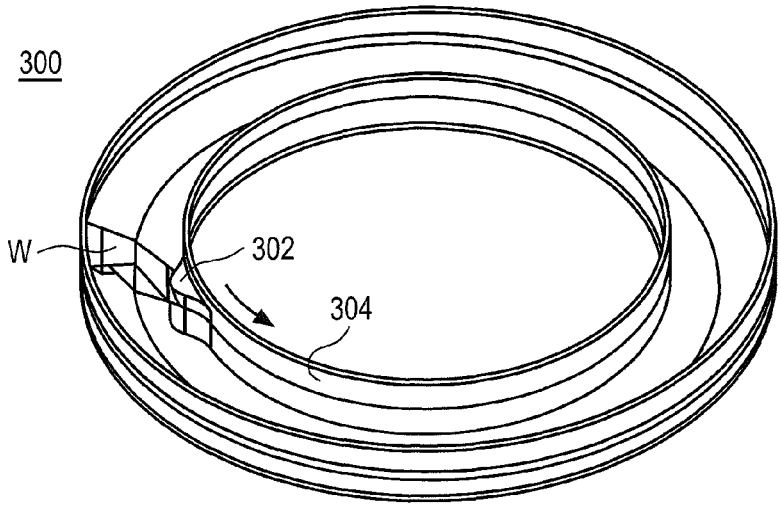
FIG. 5 illustrates a pool in an annular configuration, and a wave generator on an inner wall of the pool.
Figure 6:
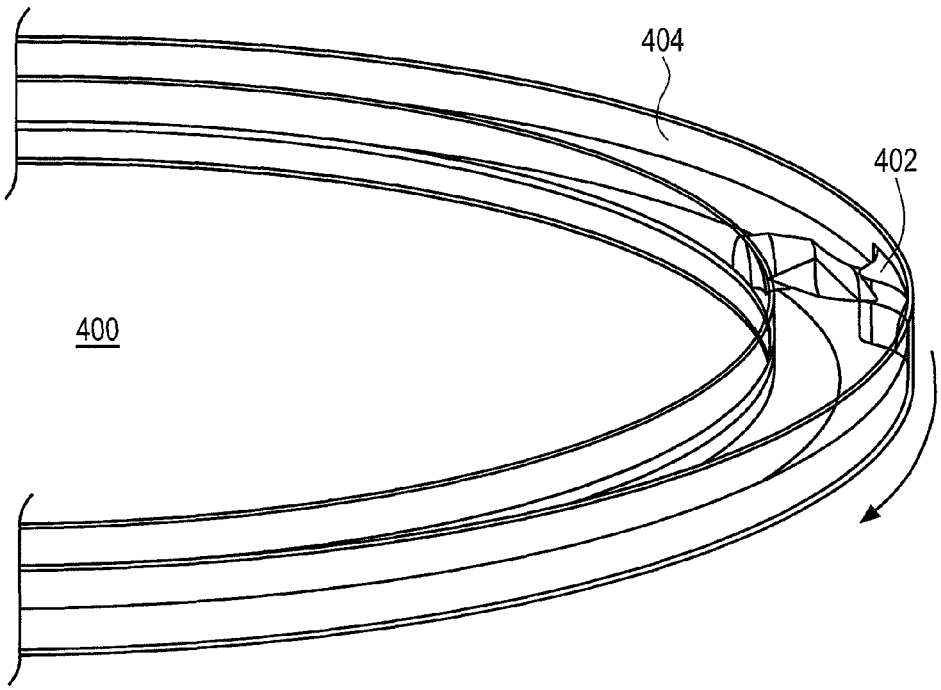
FIG. 6 illustrates a section of a pool in an annular configuration, and having a wave generator arranged vertically along an outer wall.

FIG. 5 illustrates a pool 300 in an annular configuration, and a wave generator 302 on an inner wall 304 of the pool 300. The wave generator 302 is a foil arranged vertically along the inner wall 304, and moved in the direction indicated to generate a wave W. FIG. 6 illustrates a section of a pool 400 in an annular configuration, and having a wave generator 402 arranged vertically along an outer wall 404. The wave generator 402 is moved in the direction indicated, to generate a wave W as shown. The outer wall placement enables better focusing and larger waves than an inner wall placement, while the inner wall placement enables reduced wave speed and possibly better surfability. The wave generators 302 and 402 are preferably moved by a powered vehicle or other mechanism that is kept dry and away from the water, such as on a rail or other track, part of which may be submerged.

The wave generators may also be configured to run in the center of the channel in which case there would be beaches on both the inner and outer walls and the track/rail mechanism would be supported either from an overhead structure or by pylons.

Foils

In preferred implementations, the wave pools described herein use one or more foils for generating waves of a desired surfability. The foils are shaped for generating waves in supercritical flow, i.e. the foils move faster than the speed of the generated waves. The speed of a wave in shallow water (when the water depth is comparable to the wave length) can be represented by $V_W$:

$$V_W=\sqrt{g(h_o+A)}$$

where g is the force of gravity, and $h_o$ is the depth of the water and A in the wave amplitude. Supercriticality can be represented by the Froude number (Fr), in which a number greater than 1 is supercritical, and a number less than 1 is subcritical:

$$Fr = V_F / V_W,$$

where $V_F$ is the velocity of the foil relative to the water

The foils are adapted to propagate the wave away from a leading portion of the foil as the water and foil move relative against each other, and to achieve the most direct transfer of mechanical energy to the wave from that movement. In this manner, ideal swells are formed immediately adjacent to the leading portion of the foil. The foils are usually optimized for generating the largest possible swell height for a given water depth, but in some configurations it may be desirable to generate smaller swells.

The proposed procedure relies on matching the displacement imparted by the foil at each location to the natural displacement field of the wave. For a fixed location through which the foil will pass P, if we let the direction normal to the foil be x and the thickness of the part of the foil currently at P be X(t).

The rate of change of X at the point P may be matched with the depth averaged velocity of the wave U. This expressed in equation (1).

$$\frac{dX}{dt} = \bar{u}(X, t) \tag{1}$$

Applying the change of variable from (x,t) to (θ=ct−X,t) where c is the phase speed of the wave.

$$\frac{dX}{d\theta} = \frac{\bar{u}(\theta(X))}{c - \bar{u}(\theta(X))} \tag{2}$$

In equation (2) the depth averaged velocity of the wave $\bar{u}$ can be given by many different theories, for example the Solitary wave solution of Rayleigh (Rayleigh Lord, On Waves., Phil. Mag., 1(1876), p 257-279), or that of Boussinesq (Boussinesq M. J., Théorie de l'intumescence liquide, appelée onde solitaire ou de translation, se propageant dans un canal rectangulaire, C.-R. Acad. Sci. Paris, 72(1871), p. 755-59.) For the case of Solitary waves which take the form of equation 3 and 4 below, we explore several examples. This technique of foil design may also be applies to any other form of surface gravity wave for which there is a known, computed, measured or approximated solution.

$$\eta(\theta) = A\,\mathrm{sech}^2(\beta\theta/2) \tag{3}$$

$$\bar{u}(\theta) = \frac{c\eta(\theta)}{h_o + \eta(\theta)} \tag{4}$$

Here η(θ) is the free surface elevation from rest, A is the solitary wave amplitude, $h_o$ is the mean water depth, β is the outskirts decay coefficient and c is the phase speed. And $\bar{u}(\theta)$ the depth averaged horizontal velocity. C and β will differ for different solitary waves.

Combining equations (2) and (3) with (4) gives the rate of change of the foil thickness in time at a fixed position (5), and is related to the foil shape X(Y), through the foil velocity $V_F$, by substituting $t=Y/V_F$ $$X(t) = \frac{2A}{h_0\beta}\tanh[\beta(ct - X(t))/2] \tag{5}$$

A maximum thickness of foil is given from (5) as:

$$T_F = \frac{4A}{h_0\beta}$$

The length of the active section of the foil can then be approximated as:

$$L_F = \frac{4}{\beta c}\left(\tanh^{-1}(.99 + \frac{A}{h_o}\right)$$

Values for C and β corresponding to the solitary wave of Rayleigh are:

$$\frac{\beta_R}{2} = \sqrt{\frac{3A}{4h_o^2(A + h_o)}} \text{ and } c_R = \sqrt{g(A + h_o)}$$

In this example for small displacements after linearization the foil shape X(Y), can be approximated as.

$$X_R(Y) = \frac{2A}{h_o\beta_R}\frac{h_o\tanh(\beta_R c_R Y/2V_F)}{h_o + A[1 - \tanh^2(\beta_R c_R Y/2V_F)]}$$

This solution can also be approximated with a hyperbolic tangent function.

As shown in an exemplary configuration in FIGS. 7A and 7B, the foils 500 are three-dimensional, curvilinear shaped geometries having a leading surface 502, or "active section X(Y)," that generates a wave, and a trailing surface 504 that operates as a flow recovery to avoid separation of the flow and decreasing the drag of the foil 500 for improved energy efficiency. The foil 500 is shaped to get most of the energy into the primary, solitary wave mode, and minimizes energy into oscillatory trailing waves. As such, the foil 500 promotes a quiescent environment for a following wave generator and foil, if any. Each foil 500 may contain internal actuators that allow its shape to morph to produce different waves, and/or can articulate so as to account for changes in curvature of the outer wall in non-circular or non-linear pools. In some implementations the morphing of the foil will allow for the reversal of the mechanism to generate waves by translating the foil in the opposite direction.

The foils are shaped and formed to a specific geometry based on a transformation into a function of space from an analogy to an equation as a function of time of hyperbolic tangent functions that mathematically define the stroke of a piston as a function of time, as that piston pushes a wave plate to create a shallow water wave. These hyperbolic tangent functions consider the position of the wave plate relative to the position of the generated wave in a long wave generation model, and produce an acceptable profile for both solitary and cnoidal waves. These techniques can be used to generate any propagating surface gravity wave accounting for the propagation of the wave away from the generator during generation (i.e. adapt to how the wave is changing during generation). Compensation for movement of the generator over time helps remove trailing oscillatory waves, providing a more compact and efficient generation process. Other types of waves to those discussed here can be defined.

The thickness of the foil is related to the amplitude (height) of the wave and the depth of the water. Accordingly, for a known depth and a desired amplitude A, it can be determined a thickness of the foil, $F_T$, is:

For a Rayleigh solitary wave:

$$F_T = 4\sqrt{\frac{A(A + h_o)}{3}}$$

For a Boussenesq solitary wave:

$$F_T = 4\sqrt{\frac{Ah_o}{3}}$$

For shallow water, second order solitary wave:

$$F_T = 4\sqrt{\frac{A(A + h_o)}{3}}\left(1 + \frac{A}{h_o}\right)$$

Figure 8:
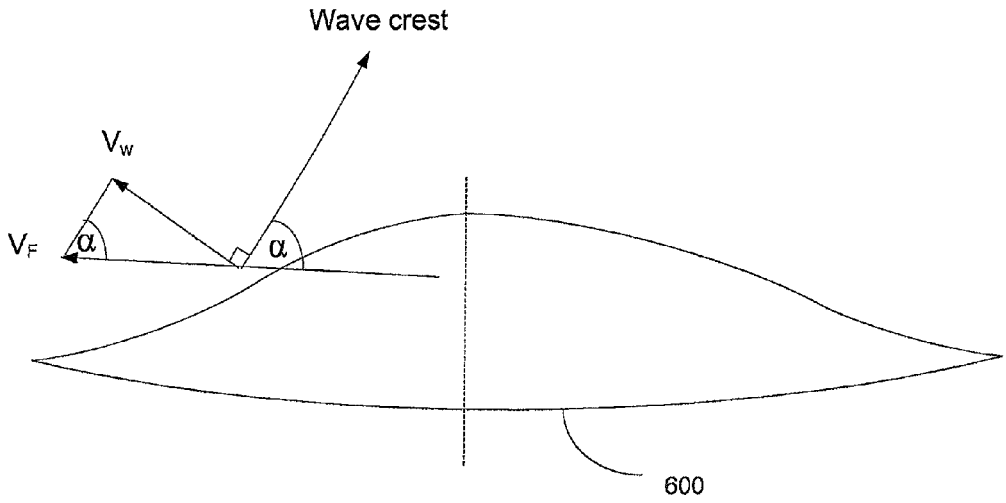
FIG. 8 shows the relative geometry of the velocity of the wave propagation with respect to the foil velocity.

FIG. 8 shows a cross-sectional geometry of a foil 600. As a three-dimensional object, the foil 600 generates a wave having a propagation velocity and vector $V_W$, based on the speed and vector of the foil $V_F$. As the foil moves in the direction shown, and dependent on its speed, the wave will propagate out at a peel angle α, given by $\sin\alpha = Fr^{-1}$, so for a given water depth and wave height the peel angle is determined by the speed of the foil, with larger speeds corresponding to smaller peel angles. The smaller the peel angle, the longer the length of the wave will be across the pool.

Figure 9:
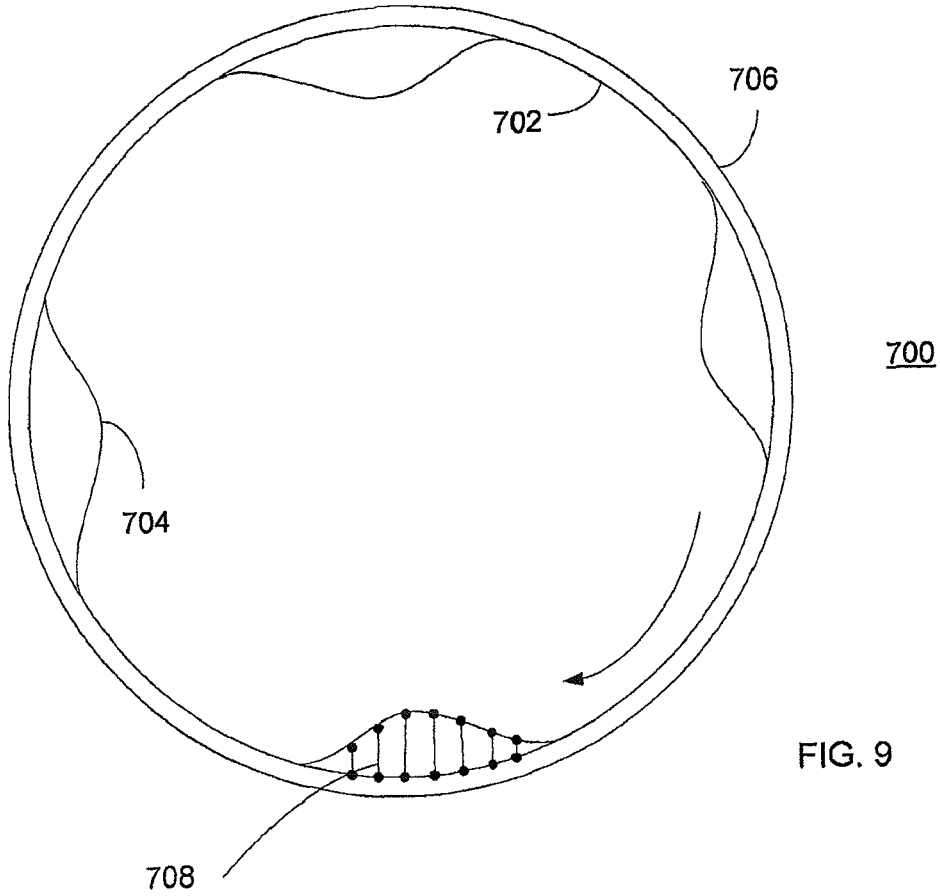
FIG. 9 illustrates a wave generator pool in which a rotating inner wall is positioned within a fixed outer wall.

FIG. 9 illustrates a wave generator 700 in which a rotating inner wall 702 is positioned within a fixed outer wall 706. The rotating inner wall 702 is equipped with one or more fixed foils 704 that are generally the same size and shape as the foils described above. These embedded foils may have internal actuators 708 to allow them to morph and change shape according to a variety of the cross-sectional shapes described above, thus accommodating "sweet spots" for different speeds and water depths.

Figure 10:
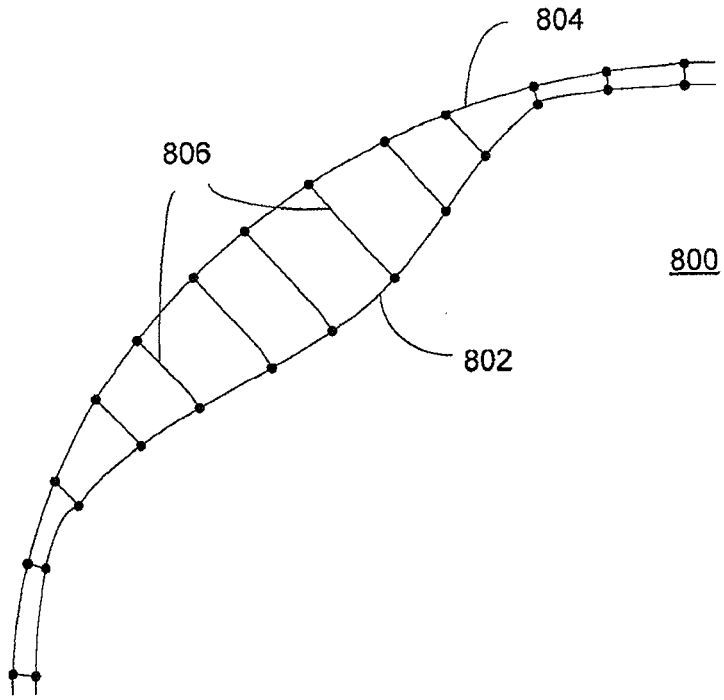
FIG. 10 illustrates a wave generator in which a flexible layer is placed on an outer wall, and the outer wall includes a number of linear actuators for being arranged around the entire length or circumference of the outer wall.

FIG. 10 illustrates a wave generator 800 in which a flexible layer 802 placed on an outer wall 804, and the outer wall includes a number of linear actuators 806 arranged around the entire length or circumference of the outer wall 804 and also attached to the flexible wall. The flexible layer 802 can be formed of rubber or a similar material. The linear actuators 806 are mechanical or pneumatic actuators, or other devices that have at least a radial expansion and retraction direction. The linear actuators are actuated in order to form a moving shape in the flexible layer 802 that approximates the shape of the foils as described above. The foil shape propagates along the wall at a velocity $V_F$ much like that of the human wave in a sports stadium.

Figure 11:
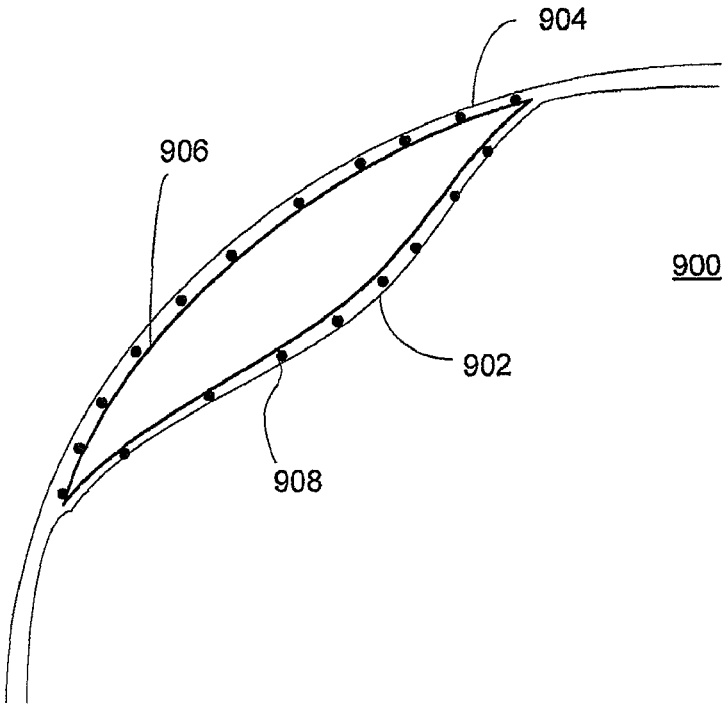
FIG. 11 illustrates a wave generator having a flexible layer placed on an outer wall.

FIG. 11 illustrates a wave generator 900 that includes a flexible layer 902 placed on an outer wall 904. The gap in between the flexible layer 902 and the outer wall 904 defines a moving foil 906 substantially as described above, but includes rollers in tracks 908 that connect to both the outer wall and the flexible wall. The rollers in tracks 908 allow the foil 906 to pass smoothly in the gap. This moving foil 906 produces a radial motion of the flexible wall that closely approximates the shape of a foil formed of a separate material, as described above.

Figure 12:
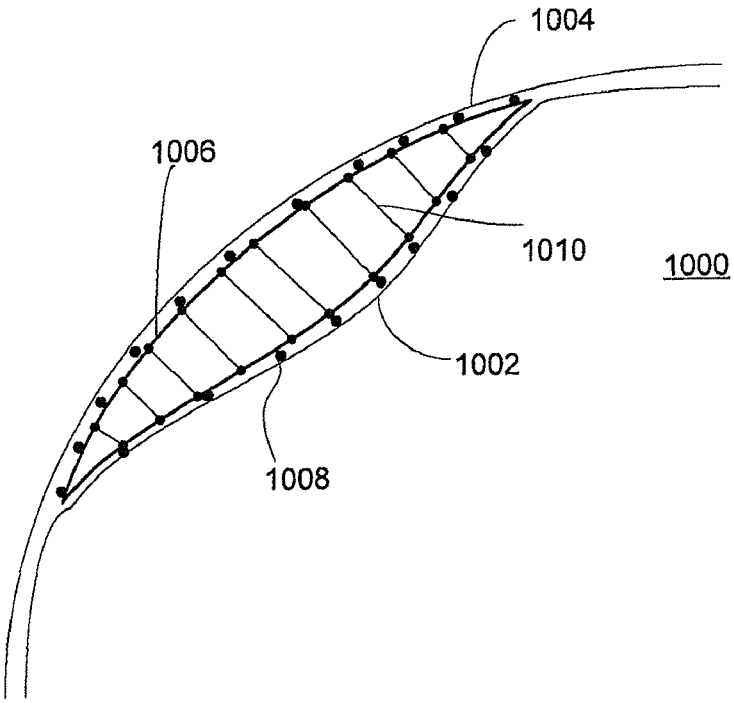
FIG. 12 illustrates a wave generator that includes a flexible layer sandwiching a foil between itself and the outer wall.

FIG. 12 illustrates a wave generator 1000 that includes a flexible layer 1002 that can be raised away from the outer wall 1004 to define a foil 1006. The foil 1006 has internal actuators 1010 that allow it to morph its shape, for forward and reverse movement. The defined foil 1006 moves via rollers on tracks 1008 as above. Accordingly, the flexible layer can be shaped to approximate the foils described above, while shielding actuators and rollers/tracks from water, while also diminishing the risk of a separate moving foil in which body parts can be caught.

Mean Flow

In other implementations, a pool includes a system to provide a mean flow or circulation. The system may include a number of flow jets through which water is pumped to counter or mitigate any "lazy river" flow created by the moving foils, and/or help to change the shape of the breaking wave. The mean circulation may have vertical or horizontal variability. Other mean flow systems may be used, such as a counter-rotational opposing side, bottom or other mechanism.

Virtual Bottom

In some implementations, a system of jets is positioned near the bottom of the pool on the slope that simulates the water being shallower than it actually is, and hence the wave breaks in deeper water than normal. These jets may be positional so as to generate both mean flow and turbulence at the required level. The distribution of these jets may change both radially and as one moved from the outer wall towards the beach with more jets on the beach. There may also be azimuthal variation in the nature and quantity of the jets. This jet system may be incorporated with both the filtering system and the system to provide mean flow or lazy river mitigation. Roughness elements may be added to the bottom to promote the generation of turbulence that may promote changes in the form of the breaking wave. The distribution and size of the roughness elements would be a function of both radius and azimuth. The roughness elements may take the form of classical and novel vortex generators.

Although a few embodiments have been described in detail above, other modifications are possible. Other embodiments may be within the scope of the following claims.

What is claimed:

1. A wave generator for a pool of water defined by a channel having a side wall, the wave generator comprising:

one or more foils, each foil arranged vertically along at least a major part of the side wall and adapted for movement in a direction along a length of the side wall, each foil having a curvilinear cross-sectional geometry that defines a leading surface that is concave about a vertical axis to generate a primary wave in the water from the movement, and a trailing surface for flow recovery behind the primary wave to avoid separation of the flow of water along the foil and to mitigate drag on the foil from the movement, the trailing surface narrowing from a maximum width of the foil adjacent the leading surface to a point at an end of the foil; and a moving mechanism connected with the one or more foils for moving the one or more foils in the direction along the length of the side wall to generate a surface gravity wave by each of the one or more foils.

2. The wave generator in accordance with claim 1, wherein the moving mechanism further includes:

a track positioned adjacent the side wall;

a vehicle associated with the one or more foils, to travel along the track; and a connecting member that connects the one or more foils to the vehicle.

3. The wave generator in accordance with claim 1, wherein the one or more foils includes four foils.

4. A wave pool comprising:

a channel containing water and having a side wall having a height, and a bottom contour that slopes upward away from the side wall toward a shoal;

one or more foils, each foil arranged vertically along at least a major part of the side wall and adapted for movement in a direction along a length of the side wall, each foil having a curvilinear cross-sectional geometry that defines a leading surface that is concave about a vertical axis to generate a primary wave in the water from the movement, and a trailing surface for flow recovery behind the primary wave to avoid separation of the flow of water along the foil and to mitigate drag on the foil from the movement, the trailing surface narrowing from a maximum width of the foil adjacent the leading surface to a point at an end of the foil.

5. The wave pool in accordance with claim 4, wherein the channel is ring-shaped.

6. The wave pool in accordance with claim 4, wherein the channel is linear.

7. The wave pool in accordance with claim 4, wherein the channel is curvilinear.

8. The wave pool in accordance with claim 4, further comprising a moving mechanism connected with the one or more foils for moving the one or more foils at a supercritical speed in the direction along the length of the side wall to generate a solitary surface gravity wave by each of the one or more foils.

9. The wave pool in accordance with claim 8, wherein the moving mechanism further includes:

a track positioned adjacent the side wall;

a vehicle associated with the one or more foils, to travel along the track; and a connecting member that connects the one or more foils to the vehicle.

10. The wave pool in accordance with claim 4, wherein the side wall includes a flexible outer wall and a rigid inner wall, and a foil forming mechanism between the flexible outer wall and the rigid inner wall to dynamically form a moving protrusion to define each of the one or more foils.

11. A wave pool comprising:

a circular channel containing water and having a side wall having a height, the circular channel further including a bottom contour that slopes upward away from the side wall toward a shoal;

a plurality of foils, each foil arranged vertically along at least a major part of the side wall and adapted to move along the side wall around the circular channel, each foil having a curvilinear cross-sectional geometry that defines a leading surface that is concave about a vertical axis to generate a primary wave in the water from the movement, and a trailing surface for flow recovery behind the primary wave to avoid separation of the flow of water along the foil and to mitigate drag on the foil from the movement, the trailing surface narrowing from a maximum width of the foil adjacent the leading surface to a point at an end of the foil.

12. The wave pool in accordance with claim 11, further comprising a moving mechanism connected between the side wall and each of the plurality of foils for moving each foil around the circular channel at a supercritical speed to generate a solitary surface gravity wave from each foil.

13. The wave pool in accordance with claim 12, wherein the moving mechanism further includes:

a track positioned adjacent the side wall;

one or more vehicles associated with the plurality of foils and adapted to travel along the track; and a connecting member attached to each foil from the one or more vehicles.

14. A wave pool comprising:

a channel containing water and having a side wall having a height, and a bottom contour that slopes upward away from the side wall toward a shoal;

one or more foils, each foil arranged vertically along at least a major part of the side wall and adapted for movement in a direction along a length of the side wall, each foil having a curvilinear cross-sectional geometry that defines a leading surface to generate a wave in the water from the movement, and a trailing surface for flow recovery to avoid separation of the flow of water in the wave and to mitigate drag from the foil from the movement, the side wall including a flexible outer wall and a rigid inner wall, and a foil forming mechanism between the flexible outer wall and the rigid inner wall to dynamically form a moving protrusion to define each of the one or more foils.

* * * * *